US010670324B2

(12) United States Patent
Besore et al.

(10) Patent No.: US 10,670,324 B2
(45) Date of Patent: Jun. 2, 2020

(54) REFRIGERATOR APPLIANCE WITH A ROTARY DAMPER ASSEMBLY

(71) Applicant: Haier US Appliance Solutions, Inc., Wilmington, DE (US)

(72) Inventors: John Keith Besore, Prospect, KY (US); Brian Michael Schork, Louisville, KY (US); Brent Alden Junge, Evansville, IN (US); Christopher Edward O'Malley, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 325 days.

(21) Appl. No.: 15/427,101

(22) Filed: Feb. 8, 2017

(65) Prior Publication Data

US 2018/0224183 A1 Aug. 9, 2018

(51) Int. Cl.
*F25D 17/04* (2006.01)
*F25D 17/06* (2006.01)

(52) U.S. Cl.
CPC ..... *F25D 17/045* (2013.01); *F25D 17/065* (2013.01)

(58) Field of Classification Search
CPC ..... F25D 2317/06; F25B 2400/0401
See application file for complete search history.

(56) References Cited

U.S. PATENT DOCUMENTS

| | | | | |
|---|---|---|---|---|
| 4,920,758 | A | 5/1990 | Janke et al. | |
| 5,758,512 | A | 6/1998 | Peterson et al. | |
| 5,899,083 | A * | 5/1999 | Peterson | F25D 17/045 62/186 |
| 6,910,340 | B2 * | 6/2005 | Nowak | F24F 13/12 236/49.5 |
| 8,074,469 | B2 * | 12/2011 | Hamel | F25D 11/022 62/441 |
| 2004/0016247 | A1 * | 1/2004 | Cho | F25D 17/045 62/186 |
| 2004/0144128 | A1 | 7/2004 | Junge et al. | |
| 2005/0011218 | A1 * | 1/2005 | Pearson | F24F 13/10 62/407 |
| 2008/0307807 | A1 * | 12/2008 | Graff | F25D 17/045 62/186 |
| 2015/0168048 | A1 * | 6/2015 | Sexton | F25D 17/045 62/329 |

* cited by examiner

*Primary Examiner* — Elizabeth J Martin
(74) *Attorney, Agent, or Firm* — Dority & Manning, P.A.

(57) ABSTRACT

A refrigerator appliance is provided having a fresh food chamber, a convertible chamber, and a freezer chamber. A fan urges a flow of cooled air from an evaporator chamber into a freezer supply duct and a secondary supply duct. A damper housing defines an inlet in fluid communication with the secondary supply duct, a first outlet in fluid communication with the convertible chamber, and a second outlet in fluid communication with the fresh food chamber. A rotary damper is mounted within the damper housing and is selectively rotated to block the flow of cooling air or to supply the flow of cooling air to one or both of the convertible chamber and the fresh food chamber.

18 Claims, 6 Drawing Sheets

REFRIGERATOR APPLIANCE WITH A ROTARY DAMPER ASSEMBLY

FIELD OF THE INVENTION

The present subject matter relates generally to refrigerator appliances, and more particularly, to refrigerator appliances having improved refrigeration systems.

BACKGROUND OF THE INVENTION

Certain refrigerator appliances utilize sealed systems for cooling chilled chambers of the refrigerator appliances. A typical sealed system includes an evaporator and a fan, the fan generating a flow of air across the evaporator and cooling the flow of air. The cooled air is then provided through an opening into the chilled chamber to maintain the chilled chamber at a desired temperature. Air from the chilled chamber is circulated back through a return duct to be re-cooled by the sealed system during operation of the refrigerator appliance, maintaining the chilled chamber at the desired temperature.

Certain refrigerators appliances also include multiple fresh food and/or freezer compartments configured for maintaining different temperatures for storing different types of food and drink. For example, a conventional bottom mount refrigerator has a fresh food chamber positioned above a freezer chamber. In addition, such a refrigerator may further include a convertible chamber positioned between the fresh food chamber and the freezer chamber. The convertible chamber, for example, may be adjusted between a conventional freezer chamber temperature and a fresh food chamber temperature (e.g., between 0° F. and 37° F.).

However, achieving different temperatures in each of the chambers of such refrigerator appliances typically requires a separate evaporator for each chamber. In this regard, a single compressor may drive refrigerant through a switching mechanism to an evaporator configured for cooling a single chamber at a time. However, additional evaporators result in added costs, more complicated assembly, and a more complex refrigerant plumbing configuration. In addition, complicated switching mechanisms may be required or operational limitations may arise, e.g., only a single chamber may be cooled at a single time due to the shared compressor.

Accordingly, a refrigerator appliance including multiple chambers sharing an improved refrigeration system would be useful. More particularly, a refrigeration system that can provide cooling air flow to multiple chambers from a single evaporator would be especially beneficial.

BRIEF DESCRIPTION OF THE INVENTION

The present subject matter provides a refrigerator appliance having a fresh food chamber, a convertible chamber, and a freezer chamber. A fan urges a flow of cooled air from an evaporator chamber into a freezer supply duct and a secondary supply duct. A damper housing defines an inlet in fluid communication with the secondary supply duct, a first outlet in fluid communication with the convertible chamber, and a second outlet in fluid communication with the fresh food chamber. A rotary damper is mounted within the damper housing and is selectively rotated to block the flow of cooling air or to supply the flow of cooling air to one or both of the convertible chamber and the fresh food chamber. Additional aspects and advantages of the invention will be set forth in part in the following description, or may be apparent from the description, or may be learned through practice of the invention.

In a first exemplary embodiment a refrigerator appliance is provided. The refrigerator appliance defines a vertical direction, a lateral direction, and a transverse direction, the vertical, lateral, and transverse directions being mutually perpendicular. The refrigerator appliance includes a cabinet including an inner liner defining a fresh food chamber, a convertible chamber, and a freezer chamber; an evaporator positioned within an evaporator chamber, the evaporator configured for cooling air in the evaporator chamber; and a fan for urging a flow of cooled air from the evaporator chamber into a freezer supply duct and a secondary supply duct. A damper housing defines a flow chamber and an inlet in fluid communication with the secondary supply duct for receiving the flow of cooled air into the flow chamber, the damper housing defining a first outlet in fluid communication with the convertible chamber and a second outlet in fluid communication with the fresh food chamber. A rotary damper is mounted within the damper housing and is rotatable about a central axis. A positioning assembly is configured for selectively rotating the rotary damper to a first angular position for blocking the flow of cooled air through the flow chamber, a second position for placing the inlet in fluid communication with the second outlet, and a third position for placing the inlet in fluid communication with the first outlet.

According to another exemplary embodiment, a refrigeration system for a refrigerator appliance is provided. The refrigerator appliance includes a freezer chamber, a convertible chamber, and a fresh food chamber. The refrigeration system includes an evaporator positioned within an evaporator chamber and a fan for urging a flow of cooled air from the evaporator chamber into a freezer supply duct and a secondary supply duct. A damper housing defines a flow chamber, an inlet in fluid communication with the secondary supply duct, a first outlet in fluid communication with the convertible chamber, and a second outlet in fluid communication with the fresh food chamber. A rotary damper is mounted within the damper housing and is rotatable about a central axis, the rotary damper including a first blade and a second blade extending from the central axis substantially along a radial direction. A positioning assembly is configured for selectively rotating the rotary damper to a first angular position for blocking the flow through the flow chamber, a second position for placing the inlet in fluid communication with the second outlet, and a third position for placing the inlet in fluid communication with the first outlet.

According to still another exemplary embodiment, a rotary damper assembly for a refrigerator appliance is provided. The refrigerator appliance includes a first chamber, a second chamber, and an evaporator positioned within an evaporator chamber. The rotary damper assembly defines a radial direction and includes a damper housing including a circular wall defining an inlet in fluid communication with the evaporator chamber, a first outlet in fluid communication with the first chamber, and a second outlet in fluid communication with the second chamber. A rotary damper is mounted within the damper housing and is rotatable about a central axis, the rotary damper including a first blade and a second blade extending from the central axis substantially along a radial direction. A positioning assembly is configured for selectively rotating the rotary damper to a first angular position for blocking the first outlet and the second outlet, a second position for placing the inlet in fluid communication with the second outlet, and a third position for placing the inlet in fluid communication with the first outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
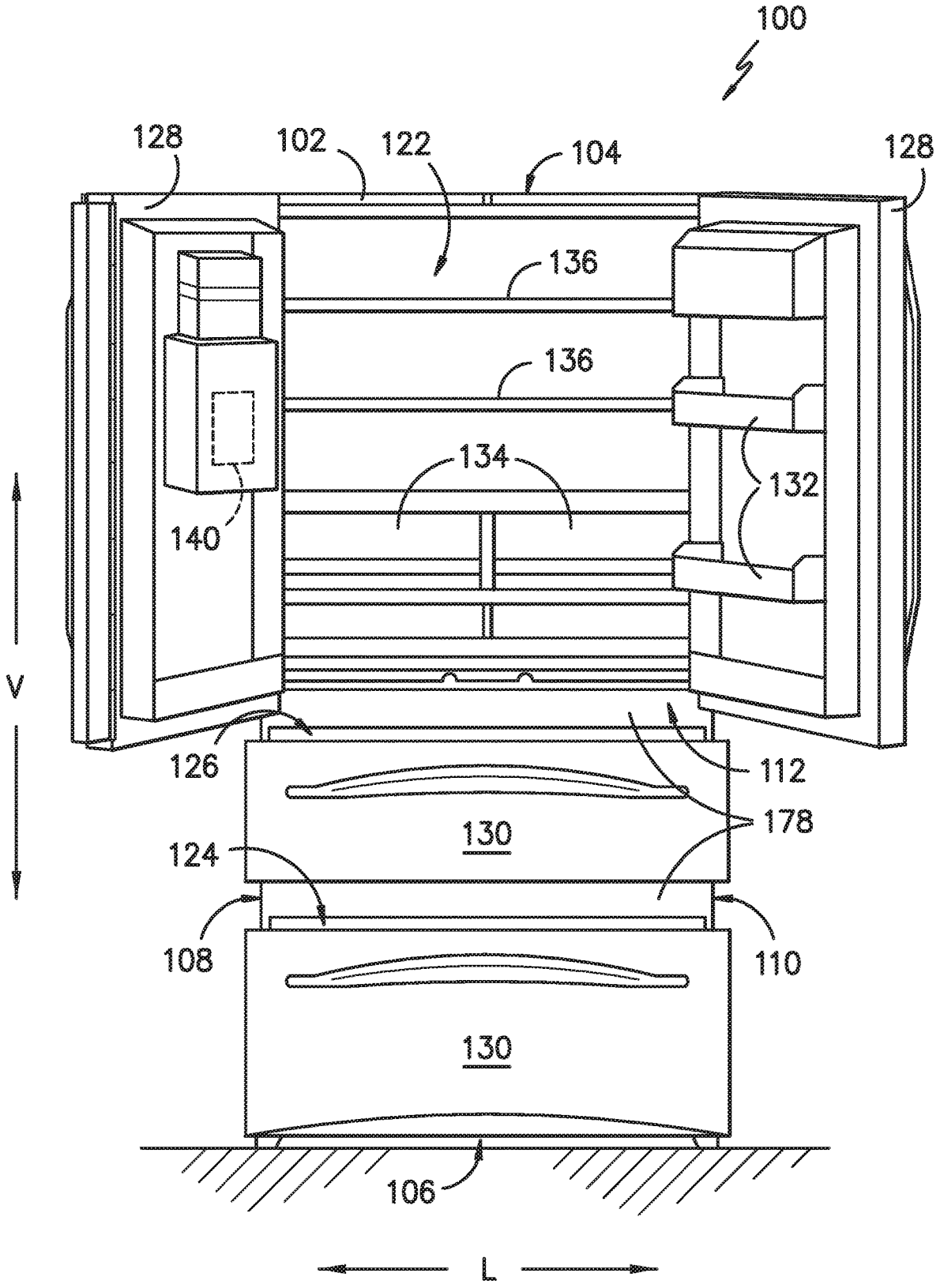
FIG. 1 provides a front view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Figure 3:
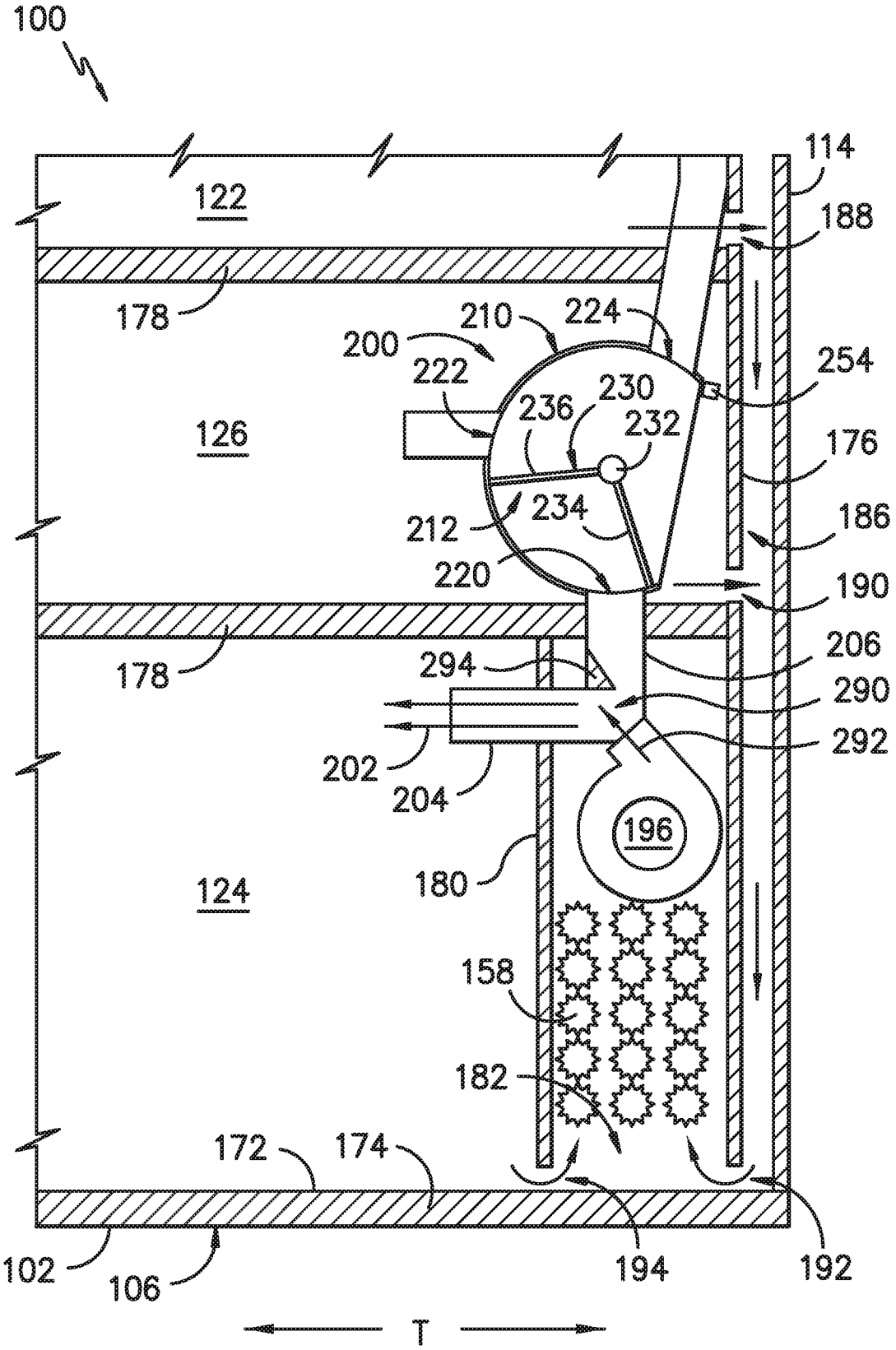
FIG. 3 provides a schematic side view of the exemplary refrigerator appliance of FIG. 1 to illustrate the flow of cooling air when a rotary damper assembly is in a first position according to an exemplary embodiment of the present subject matter.

FIG. 1 provides a front view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T (FIG. 3). Each of the vertical direction V, lateral direction L, and transverse direction T are mutually perpendicular to one another.

Housing 102 defines chilled chambers for receipt of food items for storage. In particular, housing 102 defines a fresh food chamber 122 positioned at or adjacent top 104 of housing 102, a freezer chamber 124 arranged at or adjacent bottom 106 of housing 102, and a convertible chamber 126 positioned between the fresh food chamber 122 and the freezer chamber 124 along the vertical direction V. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, freezer doors 130 are arranged below refrigerator doors 128 for selectively accessing freezer chamber 124 and convertible chamber 126. Freezer doors 130 are coupled to freezer drawers (not shown) that are slidably mounted within freezer chamber 124 and convertible chamber 126. To prevent leakage of cool air, refrigerator doors 128, freezer doors 130, and/or housing 102 may define one or more sealing mechanisms (e.g., rubber gaskets, not shown) at the interface where the doors 128, 130 meet housing 102. It should be appreciated that doors having a different style, position, or configuration are possible and within the scope of the present subject matter.

FIG. 1 provides a front view of refrigerator appliance 100 with refrigerator doors 128 and freezer doors 130 shown in an open position. According to the illustrated embodiment, various storage components are mounted within fresh food chamber 122, freezer chamber 124, and convertible chamber 126 to facilitate storage of food items therein as will be understood by those skilled in the art. In particular, the storage components include bins 132, drawers 134, and shelves 136 that are mounted within fresh food chamber 122 or freezer chamber 124. Bins 132, drawers 134, and shelves 136 are configured for receipt of food items (e.g., beverages and/or solid food items) and may assist with organizing such food items. As an example, drawers 134 can receive fresh food items (e.g., vegetables, fruits, and/or cheeses) and increase the useful life of such fresh food items.

Refrigerator appliance 100 further includes a controller 140. Operation of the refrigerator appliance 100 is regulated by controller 140 that is operatively coupled to a control panel (not shown). In one exemplary embodiment, the control panel may represent a general purpose I/O ("GPIO") device or functional block. In another exemplary embodiment, the control panel may include input components, such as one or more of a variety of electrical, mechanical or electro-mechanical input devices including rotary dials, push buttons, touch pads, and touch screens. The control panel may be in communication with controller 140 via one or more signal lines or shared communication busses. The control panel provides selections for user manipulation of the operation of refrigerator appliance 100. In response to user manipulation of the control panel, controller 140 operates various components of refrigerator appliance 100. For example, controller 140 is operatively coupled or in communication with various components of a sealed system, as discussed below. Controller 140 may also be in communication with a variety of sensors, such as, for example, chamber temperature sensors or damper position sensors. Controller 140 may receive signals from these temperature sensors that correspond to the temperature of an atmosphere or a position of a damper or damper assembly.

Controller 140 includes memory and one or more processing devices such as microprocessors, CPUs or the like, such as general or special purpose microprocessors operable to execute programming instructions or micro-control code associated with operation of refrigerator appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 140 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
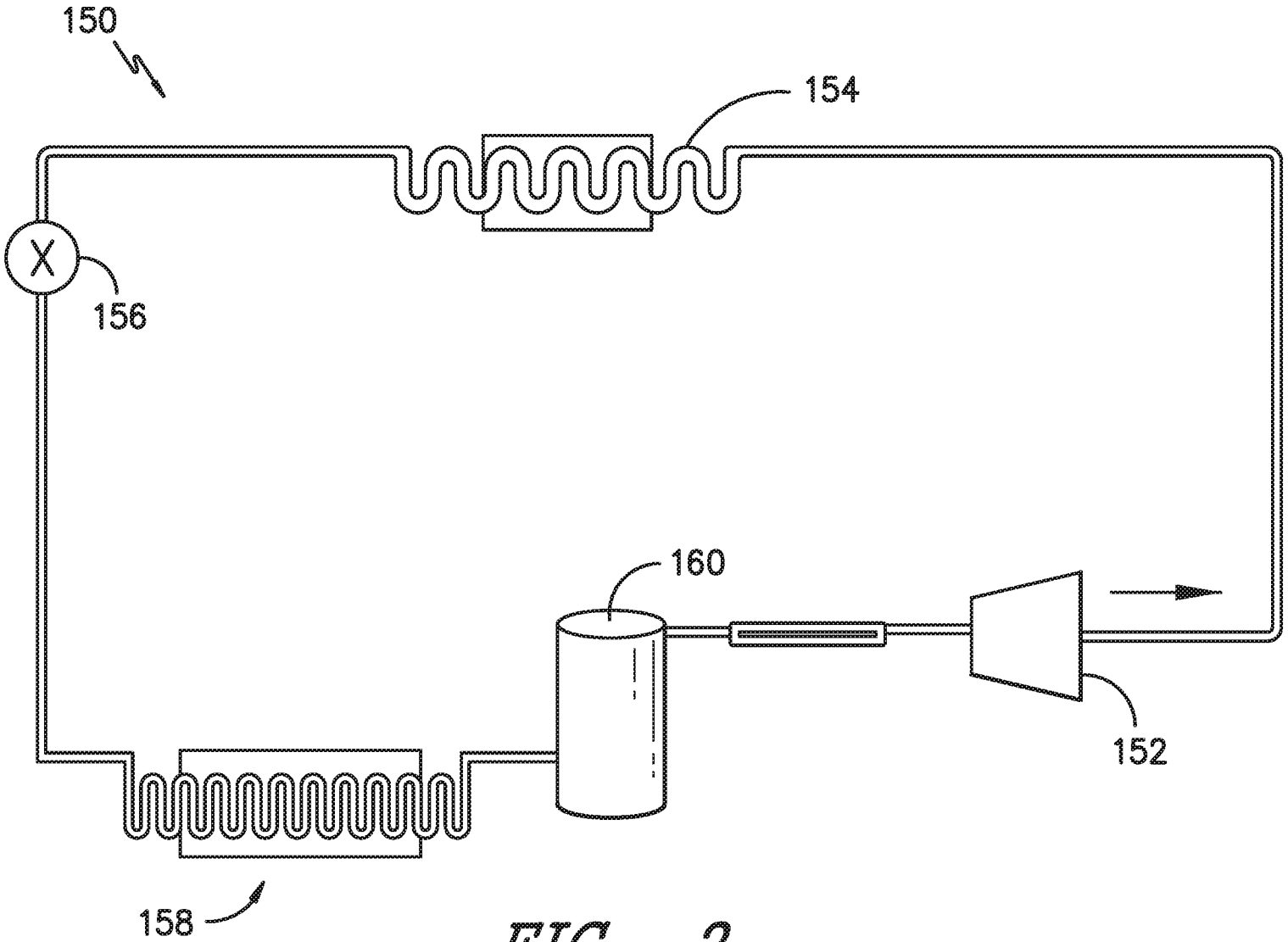
FIG. 2 provides a schematic view of a sealed cooling system configured for cooling the exemplary refrigerator appliance of FIG. 1 according to an exemplary embodiment of the present subject matter.

Referring now to FIG. 2, a schematic view of an exemplary sealed system 150 which may be used to cool fresh food chamber 122, freezer chamber 124, and convertible chamber 126 will be described. Sealed system 150 is generally configured for executing a vapor compression cycle for cooling air within refrigerator appliance 100, e.g., within fresh food chamber 122 and freezer chamber 124. Sealed cooling system 150 includes a compressor 152, a condenser 154, an expansion device 156, and an evaporator 158 connected in series and charged with a refrigerant.

During operation of sealed system 150, gaseous refrigerant flows into compressor 152, which operates to increase the pressure of the refrigerant. This compression of the refrigerant raises its temperature, which is lowered by passing the gaseous refrigerant through condenser 154. Within condenser 154, heat exchange with ambient air takes place so as to cool the refrigerant and cause the refrigerant to condense to a liquid state.

Expansion device (e.g., a valve, capillary tube, or other restriction device) 156 receives liquid refrigerant from condenser 154. From expansion device 156, the liquid refrigerant enters evaporator 158. Upon exiting expansion device 156 and entering evaporator 158, the liquid refrigerant drops in pressure and vaporizes. Due to the pressure drop and phase change of the refrigerant, evaporator 158 is cool relative to chambers 122, 124, 126 of refrigerator appliance 100. As such, cooled air is produced and refrigerates chambers 122, 124, 126 of refrigerator appliance 100. Thus, evaporator 158 is a type of heat exchanger which transfers heat from air passing over evaporator 158 to refrigerant flowing through evaporator 158.

It should be appreciated that the illustrated sealed system 150 is only one exemplary configuration of sealed system 150 which may include additional components, e.g., one or more additional evaporators, compressors, expansion devices, and/or condensers. As an example, sealed cooling system 150 may include two evaporators. As a further example, sealed system 150 may further include an accumulator 160. Accumulator 160 may be positioned downstream of evaporator 158 and may be configured to collect condensed refrigerant from the refrigerant stream prior to passing it to compressor 152.

Referring now generally to FIGS. 3 through 6, cabinet or housing 102 includes an inner liner 172 which defines chambers 122, 124, and 126. For example, inner liner 172 may be an injection-molded liner attached to an inside of housing 102. Insulation 174, such as expandable foam can be present between housing 102 and inner liner 172 in order to assist with insulating chambers 122, 124, and 126. For example, sprayed polyurethane foam may be injected into a cavity defined between housing 102 and inner liner 172 after they are assembled. Refrigerator doors 128 and freezer doors 130 may be constructed in a similar manner to assist in insulating chambers 122, 124, and 126.

According to the exemplary illustrated embodiment of FIG. 3, inner liner 172 may define a back wall 176 that extends between top 104 and bottom 106 of refrigerator appliance 100 along the vertical direction V. In addition, refrigerator appliance 100 further includes fixed or removable mullions 178 positioned within housing 102 to define fresh food chamber 122, freezer chamber 124, and convertible chamber 126. More specifically, according to the illustrated embodiment, mullions 178 generally extend between a chamber opening and back wall 176 along the transverse direction T and between first side 108 and a second side 110 along the lateral direction L. In this manner, mullions 178 are generally horizontally-oriented and split refrigerator appliance into chambers 122, 124, and 126. As illustrated, fresh food chamber 122, freezer chamber 124, and convertible chamber 126 are vertically stacked such that fresh food chamber 122 is positioned above convertible chamber 126 along the vertical direction V and convertible chamber 126 is positioned above freezer chamber 124 along the vertical direction V. However, it should be appreciated that aspects of the present subject matter may apply to refrigerator appliances having any number, size, and configuration of cooling chambers.

To limit heat transfer between fresh food chamber 122, freezer chamber 124, and convertible chamber 126, mullions 178 may generally be formed from an insulating material such as foam. In addition, to provide structural support, a rigid injection molded liner or a metal frame may surround the insulating foam. According to another exemplary embodiment, each mullion 178 may be a vacuum insulated panel or may contain a vacuum insulated panel to minimize heat transfer between fresh food chamber 122, freezer chamber 124, and convertible chamber 126. According to an exemplary embodiment, inner liner 172 and/or mullion 178 may include features such as guides or slides, e.g., to ensure proper positioning, installation, and sealing of mullion 178 within inner liner 172.

A seal, such as a rubber or foam gasket (not shown), may be positioned around a perimeter of mullions 178 where it contacts inner liner 172, refrigerator doors 128, and/or freezer doors 130. In addition, mullions 178 can be formed to have the same shape as inner liner 172 such that a tight seal is formed when mullion 178 is installed. According to the exemplary embodiment, mullions 178 may be removable such that inner liner 172 may be formed in the same shape as conventional single compartment freezer chambers. In this manner, the same tooling may be used to form both refrigerator appliances, thereby reducing costs. It should be appreciated that mullions 178 may be sized, positioned, and configured in any suitable manner to form separate chambers within refrigerator appliance 100.

Referring again generally to FIGS. 3 through 5, evaporator 158 is positioned adjacent back wall 176 of inner liner 172. An evaporator cover 180 is positioned over evaporator 158 to define an evaporator chamber 182 with inner liner 172. For example, as illustrated, evaporator cover 180 is positioned within freezer chamber 124 over evaporator 158 such that inner liner 172, mullion 178, and evaporator cover 180 define evaporator chamber 182 which houses evaporator 158.

As explained above, sealed cooling system 150 generally operates by circulating air through evaporator chamber 182 to fresh food chamber 122, freezer chamber 124, and convertible chamber 126 of refrigerator appliance 100. Therefore refrigerator appliance 100 generally includes one or more return ducts and supply ducts to allow air to circulate to and from fresh food chamber 122, freezer chamber 124, and convertible chamber 126.

For example, according to the illustrated embodiment, back wall 176 may define a primary return duct 186. Primary return duct 186 may be in fluid communication with fresh food chamber 122 through a fresh food return duct 188. Similarly, primary return duct 186 may be in fluid communication with convertible chamber 126 through a convertible return duct 190. In this manner, air from fresh food chamber 122 and convertible chamber 126 may be drawn into primary return duct 186 and passed into evaporator chamber 182 through an evaporator inlet 192. In addition, freezer chamber 124 may be in fluid communication with evaporator chamber 182 via freezer return duct 194 for returning air for circulation.

Notably, according to the illustrated embodiment, evaporator inlet 192 and freezer return duct 194 are positioned below evaporator 158 along the vertical direction V. For example, evaporator inlet 192 and freezer return duct 194 may be positioned proximate a bottom of freezer chamber 124 (e.g., proximate bottom wall 106 of refrigerator appliance 100). In this manner, any excess moisture or condensation within return air may collect below evaporator 158 instead of being drawn into the evaporator coils where it may result in frost or ice on evaporator 158. It should be appreciated, however, that according to alternative embodiments, any other suitable means for providing fluid communication between evaporator chamber 182 and the various chambers 122, 124, and 126 are possible and within the scope of the present subject matter.

Refrigerator appliance 100 may include one or more fans to assist in circulating air through evaporator 158 and evaporator chamber 182. For example, according to the illustrated exemplary embodiment, refrigerator appliance 100 includes a fan 196 in fluid communication with evaporator chamber 182 for urging air through evaporator chamber 182. According to the illustrated embodiment, fan 196 is a centrifugal fan positioned above evaporator 158 along the vertical direction V. However, it should be appreciated that fan 196 may be any suitable type, size, and configuration for circulating air through evaporator chamber 182. For example, fan 196 could be an axial fan, or each chamber could have a dedicated fan for urging cooling airflow into their respective chambers.

Referring again generally to FIGS. 3 through 6, a rotary damper assembly 200 will be described according to exemplary an exemplary embodiment of the present subject matter. In general, rotary damper assembly 200 is described herein as being used to selectively divert cooling air from sealed cooling system 150 to fresh food chamber 122, freezer chamber 124, and convertible chamber 126 in proportions to achieve desired cooling and temperatures within each of these chambers. However, it should be appreciated that aspects of the present subject matter may be used to cool any refrigerator appliance having multiple cooling chambers.

As explained above, fan 196 may be configured for drawing return air through evaporator 158 and evaporator chamber 182. Fan 196 may discharge this air as cooling air (indicated by arrows 202) into a freezer supply duct 204 and a secondary supply duct 206. Freezer supply duct 204 is in fluid communication with freezer chamber 124. Therefore, fan 196 urges cooled airflow 202 from evaporator chamber 182 through freezer supply duct 204 into freezer chamber 124 and through secondary supply duct 206 to rotary damper assembly 200, as described below.

According to the illustrated embodiment, rotary damper assembly 200 includes a damper housing 210 which defines a flow chamber 212 for receiving cooled airflow 202. More specifically, damper housing 210 may include a circular wall 214, a straight wall 216, and end walls (not shown) which together define flow chamber 212. In this regard, damper housing 210 defines flow chamber 212 as having a substantially D-shaped cross section that extends along the transverse direction T, though it should be appreciated many other suitable shapes are possible and within the scope of the present subject matter.

Damper housing 210 further includes an inlet 220 that is in fluid communication with secondary supply duct 206 for receiving the flow of cooled airflow 202 into flow chamber 212. For example, according to the illustrated embodiment, circular wall 214 defines inlet 220, which may have a substantially rectangular cross section. In addition, damper housing 210 further defines a first outlet 222 and a second outlet 224, e.g., as ducts within circular wall 214. In this regard, first outlet 222 is in fluid communication with convertible chamber 126 and second outlet 224 is in fluid communication with fresh food chamber 124.

A rotary damper 230 is mounted within damper housing 210 for selectively directing the cooled airflow 202 through one, both, or neither of first outlet 222 and second outlet 222. In this regard, rotary damper 230 is rotatable about a central axis 232 and defines a radial direction R. Rotary damper 230 includes a first blade 234 and a second blade 236 extending from central axis 232 substantially along the radial direction R. It should be appreciated, that as used herein, terms of approximation, such as "approximately," "substantially," or "about," refer to being within a ten percent margin of error. As described herein, first blade 234 and second blade 236 are generally configured for stopping the flow of cooled airflow 202 or directing that flow from inlet 220, through flow chamber 212, and through one or more of first outlet 222 and second outlet 224.

Figure 6:
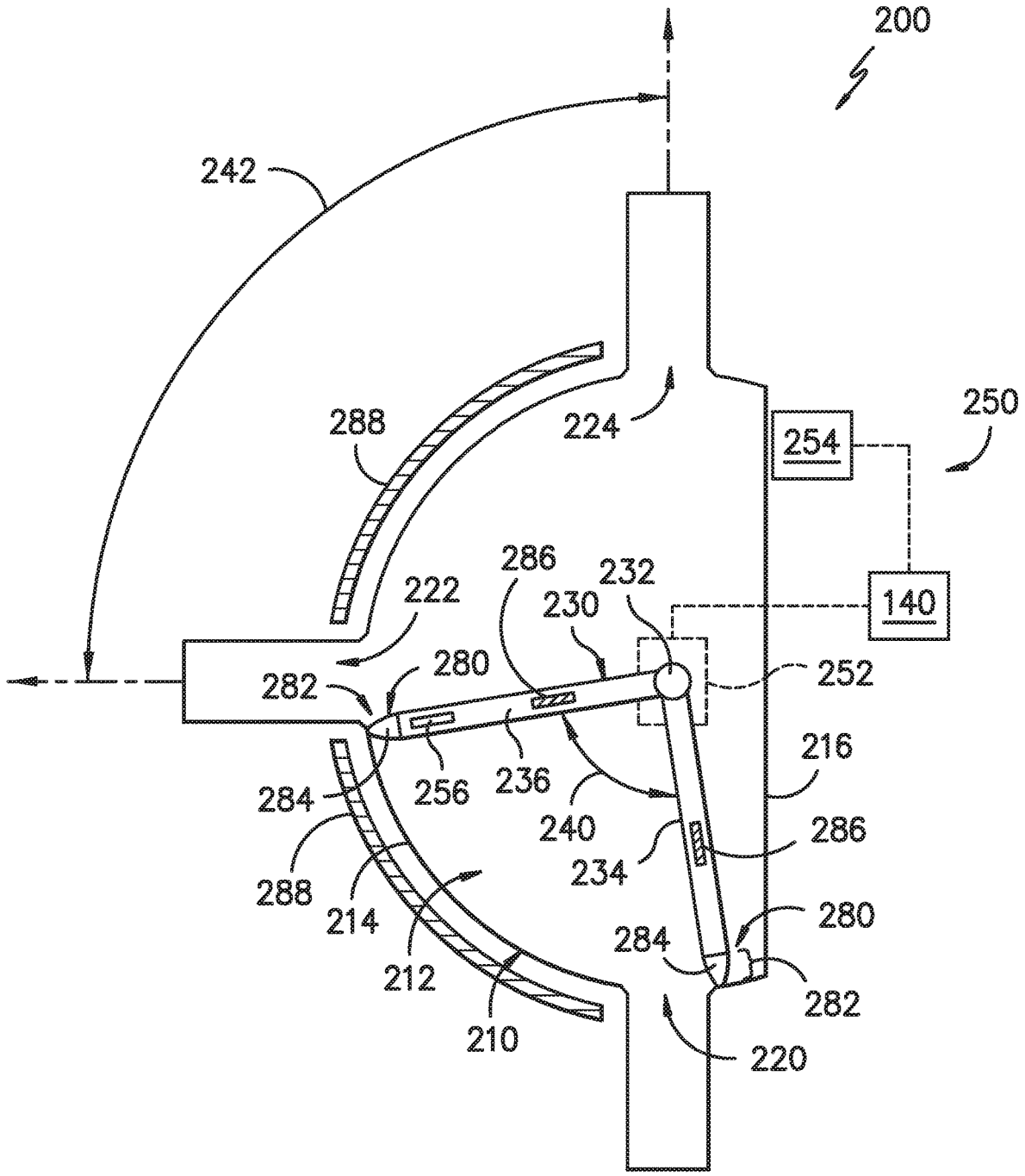
FIG. 6 provides a schematic view of the rotary damper assembly for selectively diverting the flow of cooling air within the exemplary refrigerator appliance of FIG. 1.

Referring briefly to FIG. 6, according to the illustrated embodiment, first blade 234 and second blade 236 extend from central axis 232 such that they are separated by a blade angle 240. Similarly, first outlet 222 and second outlet 224 are defined by damper housing 210 such that they are separated by outlet angle 242. According to the illustrated embodiment, outlet angle 242 is substantially equivalent to blade angle 240, e.g., about ninety degrees. In this manner, rotating the rotary damper 230 about the central axis 232 for an angular distance equivalent to the blade angle 240 will result in the isolation or blocking of first outlet 222 or second outlet 224 from flow chamber 212. It should be appreciated that according to alternative embodiments, blade angle 240 and outlet angle 242 may be adjusted to achieve different operating conditions for rotary damper assembly 200.

According to the exemplary embodiment, rotary damper assembly 200 may include a positioning assembly 250 configured for selectively rotating rotary damper 230 to the desired angular position for a given cooling operation of refrigerator appliance 100. For example, positioning assembly 250 may be configured for rotating rotary damper 230 to a first angular position (e.g., as illustrated in FIG. 3) for blocking the flow of cooled airflow 202 through flow chamber 212. Notably, when rotary damper 230 is in this first position, all of the cooled airflow 202 passes into freezer chamber 124 through freezer supply duct 204.

Figure 4:
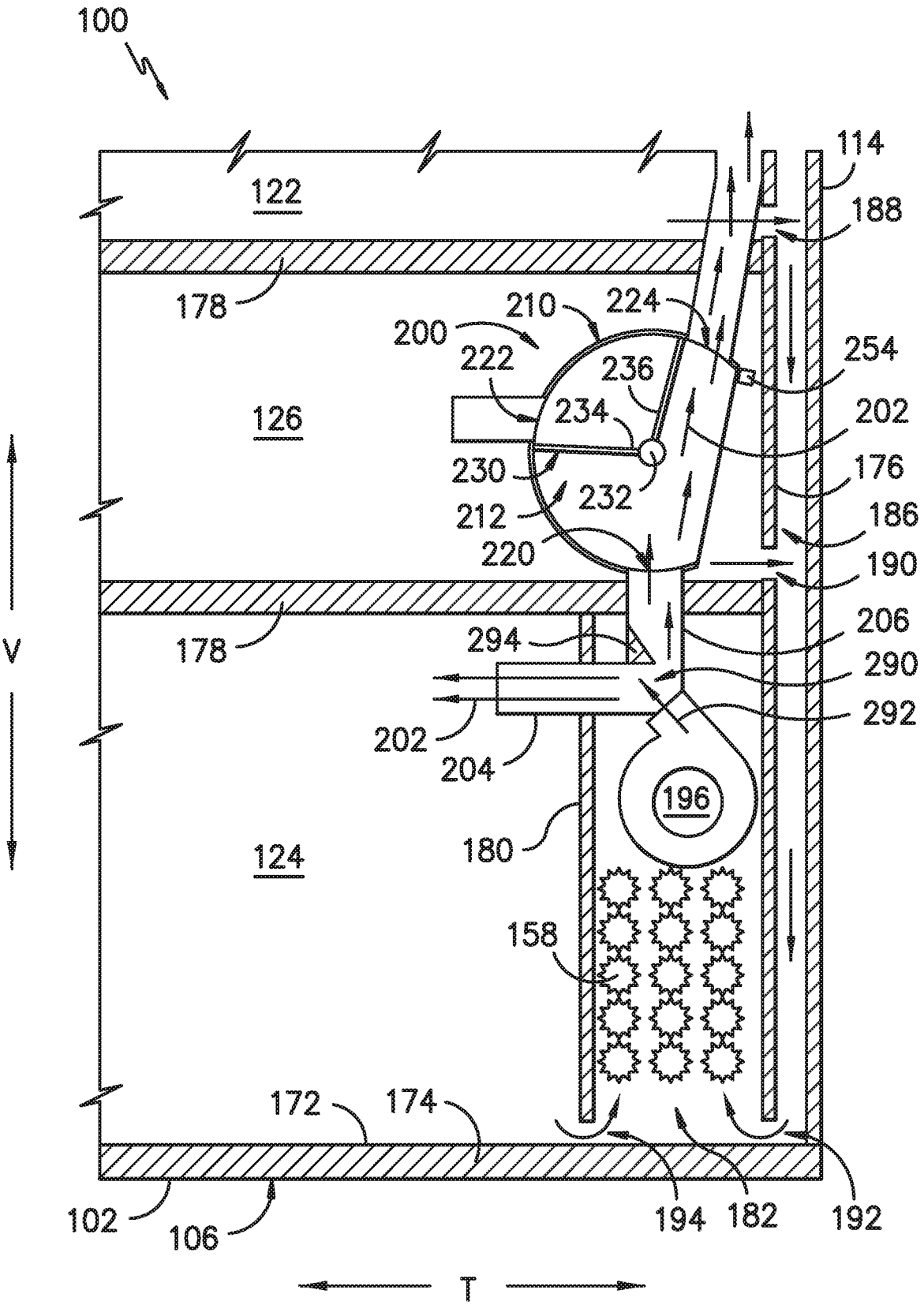
FIG. 4 provides a schematic side view of the exemplary refrigerator appliance of FIG. 1 to illustrate the flow of cooling air when the rotary damper assembly is in a second position according to an exemplary embodiment of the present subject matter.
Figure 5:
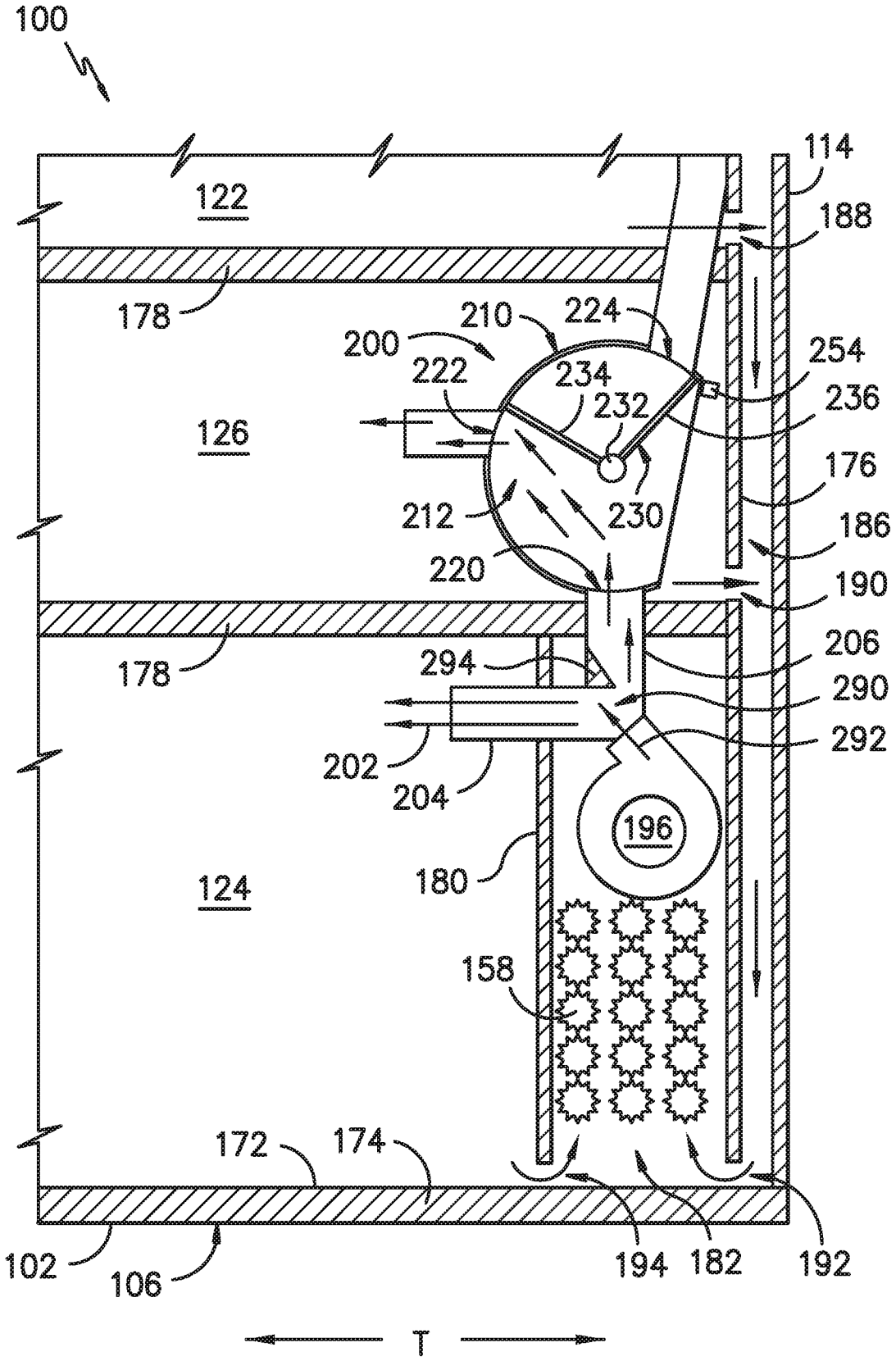
FIG. 5 provides a schematic side view of the exemplary refrigerator appliance of FIG. 1 to illustrate the flow of cooling air when the rotary damper assembly is in a third position according to an exemplary embodiment of the present subject matter.

In addition, positioning assembly 250 may rotate rotary damper 230 to a second position (e.g., as illustrated in FIG. 4) for placing inlet 220 in fluid communication with second outlet 224. When rotary damper 230 is in this second position, the cooled airflow 202 is split between freezer chamber 124 and fresh food chamber 122, while convertible chamber 126 is isolated from sealed system 150 and cooled airflow 202. Finally, positioning assembly 250 may rotate rotary damper 230 to a third position (e.g., as illustrated in FIG. 5) for placing inlet 220 in fluid communication with first outlet 222. When rotary damper 230 is in this third position, the cooled airflow 202 is split between freezer chamber 124 and convertible chamber 126, while fresh food chamber 122 is isolated from sealed system 150 and cooled airflow 202.

Referring now to FIG. 6, positioning assembly 250 may be any suitable device or apparatus for rotating rotary damper 230 about central axis 232. For example, according to the illustrated embodiment, positioning assembly 250 includes a stepper motor 252. According to the illustrated embodiment, stepper motor 252 is controlled by appliance controller 140. However, it should be appreciated that stepper motor 252 may have a dedicated controller according to alternative embodiments. It should also be appreciated that positioning assembly 250 could alternatively include an AC or DC motor having any suitable type or configuration.

In addition, positioning assembly 250 may include one or more position sensors for determining the angular position of rotary damper 230 within damper housing 210. For example, according to the illustrated embodiment, positioning assembly 250 includes a Hall-effect sensor 254 configured for sensing a magnetic tip 256 positioned on an end of second blade 236. In this regard, for example, stepper motor 252 may determine the position of rotary damper 230 by rotating it clockwise (as viewed in FIG. 6) until Hall-effect sensor 254 senses magnetic tip 256. When this occurs, controller 140 may determine that rotary damper 230 is in the "home" position and may know the position of the rotary damper 230 based on the number of pulses provided to stepper motor 252 thereafter.

Although positioning assembly 250 is described above as using Hall-effect sensor 254 and counting the number of pulses from stepper motor 252 to determine the position of rotary damper 230, positioning assembly 250 may include more sensors or different types of sensor according to alternative embodiments. For example, each of first blade 234 and second blade 236 may have a magnetic tip which may be sensed by multiple Hall-effect sensors positioned around circular wall 214. According to still another embodiment, stepper motor 252 may be coupled to rotary damper 230 through a clutch that slips when rotary damper 230 reaches the home position. Stepper motor 252 and/or controller 140 may detect this clutch slip and thereby determine the angular position of rotary damper 230. Although several methods of determining the position of rotary damper 230 are described above, it should be appreciated that these are only examples and are not intended to limit the scope of the present subject matter.

Although positioning assembly 250 is described above as rotating rotary damper 230 between three positions, it should be appreciated that positioning assembly 250 may control the position of rotary damper 230 in any suitable manner according to alternative embodiments. For example, rotary damper 230 may also be positionable at any intermediate position between the first position and the third position. In this manner, the relative amount of cooled airflow 202 flowing into convertible chamber 126 and fresh food chamber 122 may be selectively adjusted. For example, rotary damper 230 may be positioned in an intermediate position, i.e., between the second and third positions for placing inlet 220 in fluid communication with both first outlet 222 and second outlet 224. Moreover, for example, if an additional outlet is added for another chamber in refrigerator appliance, positioning assembly 250 may rotate rotary damper to a fourth position to provide cooled airflow 202 to the additional chamber.

As shown in FIG. 6, rotary damper 230 forms a relatively tight fit with circular wall 214 of damper housing 210. More specifically, first blade 234 and second blade 236 extends from central axis 232 to a distal end 280 positioned proximate circular wall 214. For example, according to an exemplary embodiment, distal end 280 is in contact with circular wall 214. According to another embodiment, a gap 282 is defined between distal end 280 and circular wall 214. For example, the gap may be between less than about ten millimeters or about one millimeter. Notably, gap 282 may reduce the likelihood of frost or ice from forming between blades 234, 236 and circular wall 214. Such ice buildup can result in rotary damper 230 binding or locking up within damper housing 210.

However, gap 282 may also allow cooled airflow 202 to bleed around first blade 234 and second blade 236. Therefore, according to the illustrated embodiment, rotary damper 230 may further include a resilient tip 284 positioned on distal end 280 of each of first blade 234 and second blade 236. Resilient tip 284 is formed from a resilient material, such as rubber, which is stiff enough to form an airtight seal with damper housing 210, but is also pliable enough to flex and break off collected frost. According to an exemplary embodiment, stepper motor 252 may be configured for intermittently rotating rotary damper 230 back and forth or oscillating slightly to break off light frost before more stubborn ice collects.

According to exemplary embodiments, rotary damper assembly 200 may further include one or more heaters for preventing ice from forming within damper housing 210 or melting ice after it forms. As illustrated in FIG. 6, a blade heater 286 is positioned within each blade 234, 236 to prevent blades 234, 236 and circular wall 214 from freezing together or binding due to ice build-up. Blade heaters 286 could be positioned proximate distal end 280 of each blade 234, 236 or may otherwise be in thermal communication with blades 234, 236 to reduce or prevent ice build-up. In addition, or alternatively, a wall heater 288 could be placed along circular wall 214 to reduce or prevent ice build-up between blades 234, 236 and circular wall 214, thereby reducing the likelihood of binding of rotary damper 230.

As illustrated in FIGS. 3 through 5, fan 196 urges cooled airflow 202 from evaporator chamber 182 through a plenum 290 that splits into two passageways. More specifically, plenum 290 divides cooled airflow 202 into a first flow that passes through freezer supply duct 204 and a second flow that passes through secondary supply duct 206. Notably, according to the illustrated embodiment, freezer supply duct 204 is unrestricted and opens directly into freezer chamber 124. To ensure that the amount of cooled airflow 202 supplied to each chamber 122, 124, 126 are sufficient to cool them to the desired temperature, it may be necessary to balance the division of airflow out of plenum 290. One exemplary configuration for achieving such a suitable balance of airflow is described below.

As illustrated, freezer supply duct 204 and secondary supply duct 206 extend from plenum 290 at approximately ninety degrees relative to each other. In addition, fan 196 is positioned and oriented such that the primary flow of air exiting fan 196 (as indicated by arrow 292 in FIGS. 3 through 5) extends approximately forty-five degrees relative to the transverse direction T, i.e., forty-five degrees relative to both freezer supply duct 204 and secondary supply duct 206. In addition, secondary supply duct 206 may define a flow restriction 294 that restricts the amount of cooled airflow 202 that passes through secondary supply duct 206. As illustrated, flow restriction 294 is a simple protruding member extending from a sidewall of secondary supply duct 204. However, according to alternative embodiments, flow restriction 294 may be a decrease in the diameter of secondary supply duct 206, an adjustable damper, or any other suitable means for restricting airflow through secondary supply duct 206. Moreover, in order to adjust the proportion of airflow through freezer supply duct 204 and secondary supply duct 206, these ducts may have any suitable size, shape, and orientation. Thus, for example, according to another exemplary embodiment, secondary supply duct 206 may have a smaller cross sectional area to provide more flow resistance and urge more cooling airflow to freezer chamber 124.

According to the illustrated embodiment, evaporator chamber 182 and evaporator 158 are positioned within freezer chamber 124 of refrigerator appliance 100. In addition, rotary damper assembly 200 is positioned within convertible chamber 126 of refrigerator appliance 100. However, it should be appreciated that according to alternative embodiments, evaporator chamber 182 and rotary damper assembly 200 may be positioned in any suitable location within refrigerator appliance 100. For example, evaporator 158 and rotary damper assembly 200 could alternatively be positioned entirely within a dedicated chamber within refrigerator appliance 100 and may pass cooled air to various chambers through separate ducts or conduits.

According to the exemplary embodiment, freezer supply duct 204, first outlet 222, and second outlet 224 are illustrated as opening directly into their respective chambers 122, 124, 126. However, it should be appreciated that according to alternative embodiments, refrigerator appliance 100 may further define one or more passageways or flow distributors downstream from freezer supply duct 204, first outlet 222, and second outlet 224 to direct the flow of cooled air into desired locations within the respective chambers 122, 124, 126. For example, each of freezer supply duct 204, first outlet 222, and second outlet 224 may terminate in a diffuser or a diffusing assembly for spreading the cooled airflow 202 evenly throughout the respective chambers 122, 124, 126. Other configurations are possible and within the scope of the present subject matter.

Using the features described above, refrigerator appliance 100 is able to maintain fresh food chamber 122 at a fixed, relatively high temperature (e.g., around 37° F. to 41° F.). In addition, refrigerator appliance 100 is able to maintain freezer chamber 124 at a fixed, relatively low temperature (e.g., around 0° F.) while allowing convertible chamber 126 to be selectively adjusted anywhere between the freezer temperature and the fresh food chamber temperature (e.g., between around 0° F. and 37° F.) or higher.

As one skilled in the art will appreciate, the above described embodiments are used only for the purpose of explanation. Modifications and variations may be applied, other configurations may be used, and the resulting configurations may remain within the scope of the invention. For example, evaporator 158 may have different positions or configurations, rotary damper assembly 200 may be modified, air supply and return ducts may be moved or may have different shapes, and different sealed system configurations may be used. Such modifications and variations are considered to be within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being perpendicular, the refrigerator appliance comprising:

a cabinet comprising an inner liner defining a fresh food chamber, a convertible chamber, and a freezer chamber;

an evaporator positioned within an evaporator chamber, the evaporator configured for cooling air in the evaporator chamber;

a fan for urging a flow of cooled air from the evaporator chamber into a freezer supply duct and a secondary supply duct;

a damper housing defining a flow chamber and an inlet in fluid communication with the secondary supply duct for receiving the flow of cooled air into the flow chamber, the damper housing being positioned downstream of the freezer supply duct, the damper housing further defining a first outlet in fluid communication with the convertible chamber and a second outlet in fluid communication with the fresh food chamber;

a rotary damper mounted within the damper housing and being rotatable about a central axis, the rotary damper comprising a first blade and a second blade extending from the central axis of the rotary damper, the first blade and the second blade being separated by a blade angle; and a positioning assembly configured for selectively rotating the rotary damper to a first angular position for blocking the flow of cooled air through the flow chamber, a second angular position for placing the inlet in fluid communication with the second outlet, and a third angular position for placing the inlet in fluid communication with the first outlet, wherein the first angular position, the second angular position, and the third angular position are different angular positions.

2. The refrigerator appliance of claim 1, wherein the blade angle is about ninety degrees.

3. The refrigerator appliance of claim 1, wherein the first outlet and the second outlet are defined by the damper housing and separated by an outlet angle, the outlet angle being substantially equivalent to the blade angle.

4. The refrigerator appliance of claim 1, wherein a gap is defined between a distal end of the first blade and the damper housing.

5. The refrigerator appliance of claim 1, wherein at least one of the first blade and the second blade comprises a resilient tip for forming a seal with the damper housing.

6. The refrigerator appliance of claim 1, further comprising at least one heater positioned in thermal communication with the damper housing or the rotary damper.

7. The refrigerator appliance of claim 1, wherein the rotary damper is positionable in an intermediate position for placing the inlet in fluid communication with both the first outlet and the second outlet.

8. The refrigerator appliance of claim 1, wherein the positioning assembly comprises a stepper motor operably coupled to the rotary damper for rotating the rotary damper.

9. The refrigerator appliance of claim 1, wherein the positioning assembly comprises a position sensor for determining an angular position of the rotary damper within the damper housing.

10. The refrigerator appliance of claim 9, wherein the position sensor is a Hall-effect sensor configured for detecting the proximity of a first blade or a second blade of the rotary damper.

11. The refrigerator appliance of claim 1, wherein the secondary supply duct comprises a flow restriction for restricting the flow of cooled air that passes through secondary supply duct.

12. The refrigerator appliance of claim 1, wherein the evaporator chamber is positioned within the freezer chamber of the refrigerator appliance.

13. The refrigerator appliance of claim 12, wherein the damper housing is positioned within the convertible chamber of the refrigerator appliance.

14. The refrigerator appliance of claim 1, wherein the fresh food chamber is positioned above the convertible chamber along the vertical direction and the convertible chamber is positioned above the freezer chamber along the vertical direction.

15. A refrigeration system for a refrigerator appliance, the refrigerator appliance comprising a freezer chamber, a convertible chamber, and a fresh food chamber, the refrigeration system comprising:

an evaporator positioned within an evaporator chamber;

a fan for urging a flow of cooled air from the evaporator chamber into a freezer supply duct and a secondary supply duct;

a damper housing defining a flow chamber, an inlet in fluid communication with the secondary supply duct downstream of the freezer supply duct, a first outlet in fluid communication with the convertible chamber, and a second outlet in fluid communication with the fresh food chamber, the first outlet and the second outlet being separated by an outlet angle;

a rotary damper mounted within the damper housing and being rotatable about a central axis, the rotary damper comprising a first blade and a second blade extending from the central axis substantially along a radial direction, the first blade and the second blade being separated by a blade angle that is substantially equivalent to the outlet angle; and a positioning assembly configured for selectively rotating the rotary damper to a first angular position for blocking the flow through the flow chamber, a second angular position for placing the inlet in fluid communication with the second outlet, and a third angular position for placing the inlet in fluid communication with the first outlet, wherein the first angular position, the second angular position, and the third angular position are different angular positions.

16. The refrigeration system of claim 15, wherein a gap is defined between a distal end of the first blade and the damper housing.

17. The refrigeration system of claim 15, wherein the positioning assembly comprises a stepper motor operably coupled to the rotary damper for rotating the rotary damper and a position sensor for determining an angular position of the rotary damper within the damper housing.

18. A rotary damper assembly for a refrigerator appliance, the refrigerator appliance comprising a first chamber, a second chamber, and an evaporator positioned within an evaporator chamber, the rotary damper assembly defining a radial direction and comprising:

a damper housing comprising a circular wall defining an inlet in fluid communication with the evaporator chamber downstream of a freezer supply duct, a first outlet in fluid communication with the first chamber, and a second outlet in fluid communication with the second chamber;

a rotary damper mounted within the damper housing and being rotatable about a central axis, the rotary damper comprising a first blade and a second blade extending from the central axis substantially along a radial direction; and a positioning assembly configured for selectively rotating the rotary damper to a first angular position for blocking the first outlet and the second outlet, a second angular position for placing the inlet in fluid communication with the second outlet, and a third angular position for placing the inlet in fluid communication with the first outlet, wherein the first angular position, the second angular position, and the third angular position are different angular positions, wherein the positioning assembly comprises a stepper motor operably coupled to the rotary damper for rotating the rotary damper and a position sensor for determining an angular position of the rotary damper within the damper housing.

* * * * *